US005501622A

United States Patent [19]

Phelan

[11] Patent Number: 5,501,622

[45] Date of Patent: Mar. 26, 1996

[54] MARINE MAMMAL GUARD

[76] Inventor: John J. Phelan, 109 Jeanette Ave., Inwood, N.Y. 11696

[21] Appl. No.: 438,029

[22] Filed: May 8, 1995

[51] Int. Cl.[6] ..... B63H 5/16

[52] U.S. Cl. ..... 440/71; 416/247 A

[58] Field of Search ..... 440/66, 67, 68, 440/71, 72; 416/247 A, 247 R

[56] References Cited

U.S. PATENT DOCUMENTS

| | | | |
|---|---|---|---|
| D. 322,074 | 12/1991 | Hansen | D15/4 |
| 3,658,028 | 4/1972 | Koons | 440/71 |
| 4,013,033 | 3/1977 | Porter et al. | 440/72 |
| 4,057,028 | 11/1977 | Palka | 115/42 |
| 4,070,984 | 1/1978 | Kappas | 440/72 |
| 4,411,631 | 10/1983 | Makinen et al. | 440/72 |
| 4,826,461 | 5/1989 | Newman | 440/72 |
| 4,957,459 | 9/1990 | Synder | 440/71 |
| 5,066,254 | 11/1991 | Bass et al. | 440/72 |
| 5,224,889 | 7/1993 | Hickey | 440/71 |

*Primary Examiner*—Stephen Avila
*Attorney, Agent, or Firm*—Richard L. Miller

[57] ABSTRACT

A marine mammal guard for an outboard motor having a drive shaft housing, an anti-cavitation plate, a lower support unit, a gear casing, a skeg and a propeller hub with a plurality of propeller blades radially thereabout. The guard comprises a protective housing having a pair of forward intake ports and a rearward exit port. A mechanism is provided for securing the protective housing to the lower support unit. The protective housing will extend about the gear casing, the propeller hub and propeller blades below and parallel to the anti-cavitation plate and above the skeg, so as to prevent animals and other objects also submerged within water from coming into contact with the propeller blades of the outboard motor.

4 Claims, 1 Drawing Sheet

MARINE MAMMAL GUARD

BACKGROUND OF THE INVENTION

The instant invention relates generally to propeller guards and more specifically it relates to a marine mammal fish guards for a boat propeller.

Numerous propeller guards have been provided in prior art that are adapted to protect the propellers on boats against damage to the propellers and objects that come in contact with the propellers. For example, U.S. Des. No. 322,074 to Hansen; U.S. Pat. Nos. 4,057,028 to Palka; 4,411,631 to Makinen et al.; 5,066,254 to Bass et al.; and 5,224,889 to Hickey all are illustrative of such prior art. While these units may be suitable for the particular purpose to which they address, they would not be as suitable for the purposes of the present invention as heretofore described.

SUMMARY OF THE INVENTION

A primary object of the present invention is to provide a marine mammal guard that will overcome the shortcomings of the prior art devices.

Another object is to provide a marine mammal guard that is an elastomeric boot, which partially encloses a boat propeller, has a pair of forward intake ports and a fitted foam blocks inside to fit snugly on the motor thereby reducing vibration and accordingly inhibiting movement of the guard relative to the motor.

An additional object is to provide a marine mammal guard that will protect marine mammals, such as the Manatee of southern Florida, from the deadly blades of a propeller on a motor boat, but will also increase the efficiency of the propeller.

A further object is to provide a marine mammal guard that is simple and easy to use.

A still further object is to provide a marine mammal guard that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
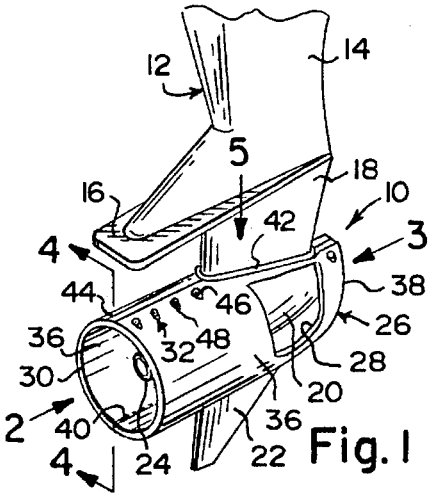
FIG. 1 is a diagrammatic perspective view of the instant invention installed on a typical out board motor.
Figure 2:
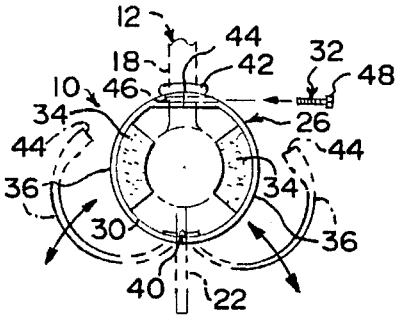
FIG. 2 is an enlarged diagrammatic rear elevational view taken in the direction of arrow 2 in FIG. 1, illustrating two hinged components in phantom separately pivoted away from each other.
Figure 3:
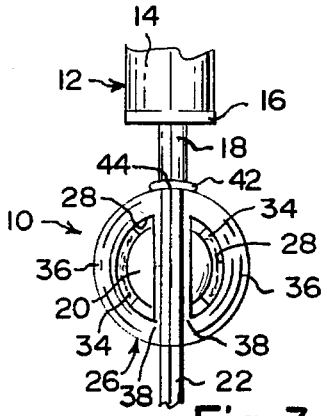
FIG. 3 is an enlarged diagrammatic front elevational view taken in the direction of arrow 3 in FIG. 1.
Figure 4:
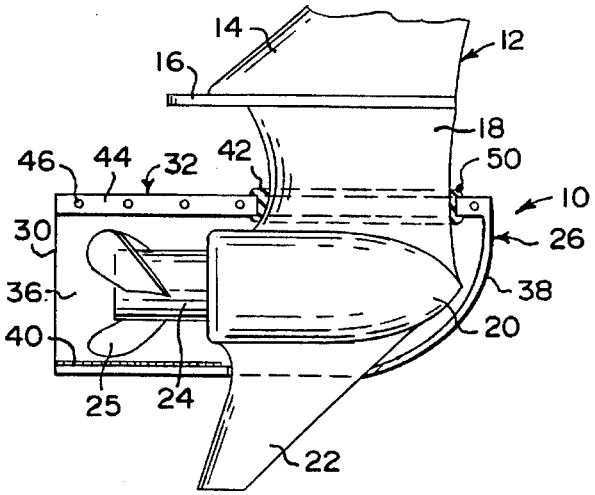
FIG. 4 is an enlarged diagrammatic side view taken on line 4—4 of FIG. 1, with one hinged component removed.
Figure 5:
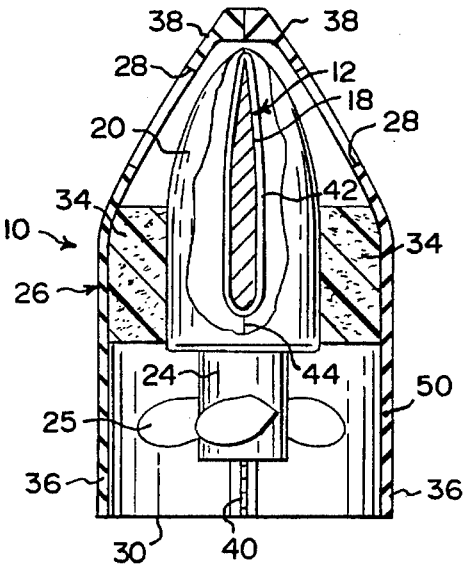
FIG. 5 is an enlarged diagrammatic top view taken in the direction of arrow 5 in FIG. 1, with parts broken away and in section.

Turning now descriptively to the drawings, in which similar reference characters denote similar elements throughout the several views, FIGS. 1 through 5 illustrate a marine mammal guard 10 for an outboard motor 12, having a drive shaft housing 14, an anti-cavitation plate 16, a lower support unit 18, a gear casing 20, a skeg 22 and a propeller hub 24 with a plurality of propeller blades 25 radially thereabout. The guard 10 comprises a protective housing 26, having a pair of forward intake ports 28 and a rearward exit port 30. A structure 32 is for securing the protective housing 26 to the lower support unit 18. When the protective housing 26 is attached to the outboard motor it will extend about the gear casing 20, the propeller hub 24 and propeller blades 25 below and parallel to the anti-cavitation plate 16 and above the skeg 22, so as to protect marine animals from coming in contact with the propeller blades 25.

Fitted foam blocks 34 are mounted between the protective housing 26 and the gear casing 20, so that the protective housing 26 will fit snugly thereto, thereby reducing vibration and inhibiting movement of the protective housing 26, with respect to the outboard motor 12. The protective housing 26 consists of a pair of generally semi-circular cylindrical components 36, each having a tapered forward end 38 with one forward intake port 28 and half of the exit port 30. A hinge 40 runs lengthwise along lower edges between the components 36 from the rearward exit port up to an opening for the skeg 22.

The securing structure 32 includes a gasket 42 to fit about the lower support unit 18 at the junction of a portion of upper mating edges 44 of the components 36. The upper mating edges 44 of the components 36 have a plurality of aligned spaced apart transverse bores 46 therethrough. A plurality of bolts 48 are provided to be received into the threaded bores 46, to keep the upper mating edges 44 of the components 36 locked closed.

The components 36 of the protective housing 26 are fabricated typically out of metal or an elastomeric material 50. The gasket 42 typically may be fabricated out of the elastomeric material 50.

OPERATION OF THE INVENTION

To use the marine mammal guard 10, the instant invention is simply installed with the gasket 42 about the lower support unit 18, while the skeg protrudes from the appropriate opening thus provided. The two fitted foam blocks 34 are accordingly sandwiched between the two components 36 of the protective housing 26 and the gear casing 20. The upper mating edges 44 are then secured abutting each other by the bolts 48 threaded into the bores 46. The two components 36 of the protective housing 26 are of a proper size to extend about the gear casing 20, the propeller hub 24 and the propeller blades 25 to protect marine mammals, such as manatees, or other large animal submerged in the water from being injured or killed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

The invention claimed is:

1. A marine mammal guard for an outboard motor having a drive shaft housing, an anticavitation plate, a lower support unit, a gear casing, a skeg and a propeller hub with a plurality of propeller blades radially thereabout, said guard comprising:

a) a protective housing having a pair of forward intake ports and a rearward exit port; and b) means for securing said protective housing to the lower support unit, so that said protective housing will extend about the gear casing, the propeller hub and propeller blades below and parallel to the anticavitation plate and above the skeg, so as to protect marine animals from the propeller blades; and c) at least two fitted foam blocks mounted between said protective housing and the gear casing, so that said protective housing will fit snugly thereto, thereby reducing vibration and inhibiting movement of said protective housing with respect to said outboard motor, wherein said protective housing includes:

i) a pair of generally semi-circular cylindrical components., each having a tapered forward end with one said forward intake port and half of said rearward exit port; and ii) a hinge running lengthwise along lower edges between said components from said rearward exit port up to an opening provided for the skeg, wherein said securing means includes:

I) a gasket to fit about the lower support unit at the junction of a portion of upper mating edges of said components;

II) said upper mating edges of said components having a plurality of aligned spaced apart transverse bores therethrough; and III) a plurality of bolts to thread into said bores, to keep said upper mating edges of said components abutted together closed.

2. A marine mammal guard as recited in claim 1, wherein said gasket is fabricated out of an elastomeric material.

3. A marine mammal guard as recited in claim 2, wherein said components of said protective housing are fabricated out of an elastomeric material.

4. A marine mammal guard as recited in claim 2, wherein said components of said protective housing are fabricated out of metal.

* * * * *